US011497107B2

(12) United States Patent
Chen et al.

(10) Patent No.: US 11,497,107 B2
(45) Date of Patent: Nov. 8, 2022

(54) X-RAY MACHINE RAY TUBE HEAT DISSIPATION DEVICE

(71) Applicant: CITIC Dicastal Co., Ltd., Qinhuangdao (CN)

(72) Inventors: Jianwei Chen, Qinhuangdao (CN); Zhiqiang Zhao, Qinhuangdao (CN); Hongyu Wang, Qinhuangdao (CN)

(73) Assignee: CITIC Dicastal Co., Ltd., Qinhuangdao (CN)

( * ) Notice: Subject to any disclaimer, the term of this patent is extended or adjusted under 35 U.S.C. 154(b) by 149 days.

(21) Appl. No.: 17/092,632

(22) Filed: Nov. 9, 2020

(65) Prior Publication Data

US 2021/0159041 A1 May 27, 2021

(30) Foreign Application Priority Data

Nov. 25, 2019 (CN) ..... 201911161760.X

(51) Int. Cl.
*H05G 1/02* (2006.01)

(52) U.S. Cl.
CPC ..... *H05G 1/025* (2013.01); *H01J 2235/1216* (2013.01)

(58) Field of Classification Search
CPC ..... H05G 1/025; H01J 2235/1216
See application file for complete search history.

(56) References Cited

U.S. PATENT DOCUMENTS

2002/0146092 A1* 10/2002 Richardson ..... H05G 1/025 378/119
2005/0243969 A1* 11/2005 Andrews ..... H05G 1/025 378/119
2006/0280292 A1* 12/2006 McCarthy, Jr. ..... H05G 1/02 378/200
2015/0124936 A1* 5/2015 Anno ..... H01J 35/106 378/130

FOREIGN PATENT DOCUMENTS

CN 108760786 A * 11/2018

* cited by examiner

*Primary Examiner* — Chih-Cheng Kao
(74) *Attorney, Agent, or Firm* — IPRO, PLLC

(57) ABSTRACT

The invention discloses X-ray machine ray tube heat dissipation device which comprises a heat dissipation pool and an X-ray machine ray tube arranged in the heat dissipation pool, wherein the heat dissipation pool is provided with a water inlet and a water outlet, and the water outlet of the heat dissipation pool is communicated with the water inlet of water tank.

9 Claims, 2 Drawing Sheets

X-RAY MACHINE RAY TUBE HEAT DISSIPATION DEVICE

TECHNICAL FIELD

The disclosure herein relates to the field of radiation of a ray tube, in particular to an X-ray machine ray tube heat dissipation device.

BACKGROUND

In the field of manufacturing of automobile hubs, in order to ensure the manufacturing quality of the hubs, after the hubs are subjected to die casting molding, the hubs need to be scanned by using X-ray machine rays to detect whether casting cavities exist in the hubs or not, and the hubs with the cavities are judged to be rejected products and then are remelted and die-cast.

When an X-ray tube in an X-ray machine emits high-pressure rays, high temperature is generated, the tube can be damaged irreparably in 3-4 months in the continuous operation of a factory, and only the tube can be replaced. One ray tube is often hundreds of thousands of yuan, which causes extremely high cost loss for the operation of automobile hub enterprises.

SUMMARY

In view of this, the present invention provides a heat dissipation device for an X-ray tube, which can prolong the service life of the X-ray tube and reduce the operation cost of a company.

In order to achieve the purpose, the technical scheme of the invention is realized as follows:

An X-ray machine ray tube heat dissipation device, includes the heat dissipation pool and arranges the X-ray machine ray tube in the heat dissipation pool in, is provided with water inlet and delivery port on the heat dissipation pool, the water inlet of heat dissipation pool's delivery port intercommunication water tank, the input of water tank's delivery port intercommunication motor pump, motor pump's output intercommunication water flow meter input, water flow meter's output intercommunication one-way valve's input, one-way valve's output intercommunication water flow electronic control unit input, water flow electronic control unit's output intercommunication heat dissipation pool's water inlet.

In some embodiments, the water flow control unit comprises tubular structure, a through hole is arranged on first fixing part arranged on the upper part of the inner wall of the unit, and a first magnetic device is arranged on the lower end face of first fixing part.

In some embodiments, the inner wall of tubular structure has a lower portion second fixing part capable of sealing tubular structure and a through hole corresponding to the position of the first magnetic device, the through hole has a sealing structure matching with the through hole, and the upper portion of the sealing structure has a second magnetic device with the same magnetism as the first magnetic device.

In some embodiments, the sealing structure includes conical float embedded into second fixing part through hole with apex down, the upper end face of conical float provided with a second magnetic means.

In some embodiments, magnetoelectric switch is provided on the outer side of the tube wall of tubular structure corresponding to position second fixing part to electrically connect with the X-ray ray tube.

In some embodiments, the vertebral float comprises a cone-shaped structure, and the through-hole of second fixing part comprises a circular through-hole.

In some embodiments, the first and second magnetic means comprise magnets.

In some embodiments, the height h of the vertebral float is greater than tubular structure inner cross-sectional diameter d.

In some embodiments magnetoelectric switch is electrically connected to the CPU of X-ray ray tube.

Compared with the prior art, the X-ray machine ray tube heat dissipation device provided by the invention has the following advantages:

The working convenience of workers is improved, ray tube is effectively prevented from being in a high-temperature state for a long time, the service life of ray tube is prolonged, and the operating cost of a company is greatly reduced.

BRIEF DESCRIPTION OF FIGURES

The accompanying drawings, which are included to provide a further understanding of the invention, illustrate embodiments of the invention and together with the description serve to explain the invention and do not constitute a limitation of the invention. In the drawings.

DESCRIPTION OF REFERENCE NUMERALS

Figure 1:
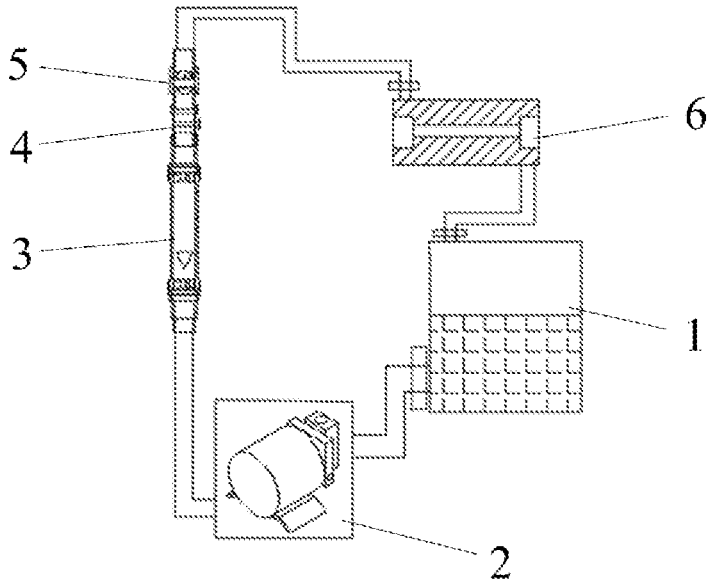
FIG. 1 is a block diagram of X-ray machine ray tube heat dissipation device of the present invention.

1—water tank, 2—motor pump, 3—water flow meter, 4—one-way valve, 5—water flow electronic control unit, 6—ray tube, 51—tubular structure, 52—first fixing part, 54—second fixing part, 55—conical float, 57—magnetoelectric switch.

DETAILED DESCRIPTION

It should be noted that embodiments of the present disclosure and features of the embodiments may be combined with one another without conflict.

The technical solution of the present disclosure will be described clearly and completely hereinafter with reference to the accompanying drawings and in combination with embodiments, and obviously, the embodiments described are only a part of embodiments of the present disclosure, and are not all of embodiments thereof. Based on the embodiments of the present disclosure, all other embodiments obtained by a person of ordinary skill in the art without involving any inventive effort fall within the protection scope of the present disclosure.

The X-ray machine ray tube heat dissipation device of an embodiment of the present invention is described below in conjunction with an embodiment with reference to FIG. 1-4.

Figure 2:
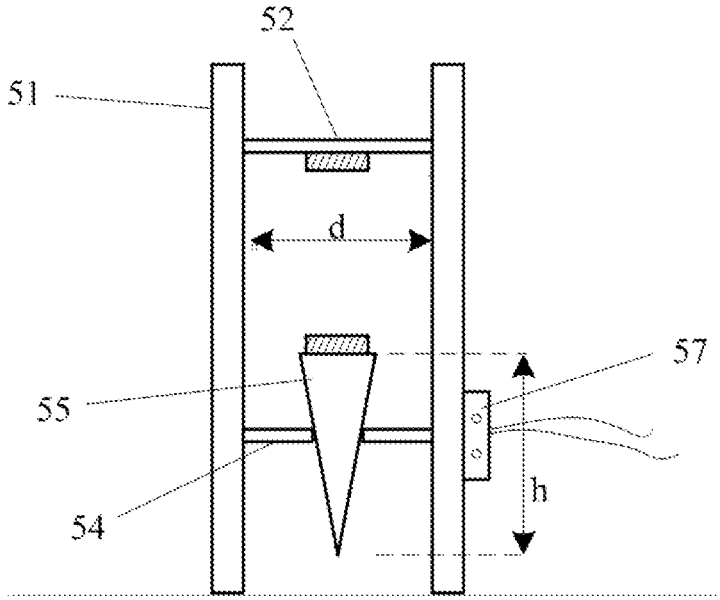
FIG. 2 is a longitudinal cross-sectional view of water flow electronic control unit of the present invention.
Figure 3:
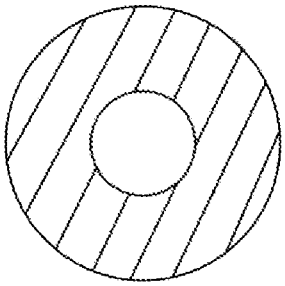
FIG. 3 is a transverse cross-sectional view of second fixing part of the present invention.

In some embodiments, the X-ray machine ray tube heat dissipation device, including water tank 1, motor pump 2, water flow meter 3, one-way valve 4 and water flow electronic control unit 5, the water inlet of water tank 1 is used for communicating with the water outlet of X-ray machine ray tube 6, the water outlet of water tank 1 is communicated with the water inlet of motor pump 2 through a water pipe, the water outlet of motor pump 2 is communicated with the water inlet of water flow meter 3 through a water pipe, the water outlet of water flow meter 3 is connected with the water inlet of one-way valve 4 through a screw thread, the outlet of one-way valve 4 is connected with the water inlet of water flow electronic control unit 5 through a screw thread, the water outlet of water flow electronic control unit 5 is used for communicating with the water inlet of ray tube 6, wherein:

Water flow electronic control unit 5 is tubular structure 51 which is connected from top to bottom, as shown in FIG. 2, first fixing part 52 is arranged on the upper part of the inner wall of tubular structure 51, a through hole which is through from top to bottom is arranged on first fixing part 52, and a magnet is arranged at the center of the lower end face of first fixing part 52;

Tubular structure 51 has an inner wall lower part second fixing part 54, as shown in FIG. 2, second fixing part 54 is a ring sealing structure with a circular through hole at the center position, as shown in FIG. 3, conical float 55 with a cone structure is arranged at the center position of second fixing part 54, conical float 55 vertex of 8555 is downward embedded in the circular through hole of second fixing part 54, the upper end face of the upper section of conical float 55 is provided with a magnet with the same polarity as the magnet of the lower section of first fixing part 52, conical float 55 and second fixing part 54 form an up-and-down sealing structure under the action of like-pole repulsion magnetic force;

As shown in FIG. 2, magnetoelectric switch 57 and magnetoelectric switch 57 are fixed on the outer side of the tube wall of tubular structure 51 and at the same level as second fixing part 54, and are used for connecting a CPU of the X-ray machine.

In some embodiments, when water tank 1 is free of water or motor pump 2 is not in operation, i.e. no cooling water flows through, the float in water flow meter 3 has no flow measurement value at the measurement zero point, conical float 55 of water flow electronic control unit 5 forms an upper and lower sealing structure with second fixing part 54 under the action of magnetic force of like poles repelling each other;

When water tank 1 has water and motor pump 2 operation to meet simultaneously, under the power action of motor pump 2, cooling water in water tank 1 enters water flow meter 3 through motor pump 2, at the moment, a floater in water flow meter 3 floats to measure a flow value, the cooling water enters water flow electronic control unit 5 through one-way valve 4, conical float 55 floats upwards under the thrust action of the cooling water against the magnetic force of like polarity repulsion to separate from second fixing part 54, the water flows out from a water outlet of water flow electronic control unit 5 through a through hole of first fixing part 52 and enters a water inlet of ray tube 6, a water outlet of ray tube 6 is communicated with a water inlet of water tank 1 to form a cooling circulation system, and the aim of cooling is fulfilled to ray tube 6 during operation.

When the X-ray machine works, if the conditions of water tank 1 water leakage, motor pump 2 damage, one-way valve 4 closing and the like occur, the water flow is zero or is too small, the thrust of the water flow is insufficient to overcome the magnetic force action of like polarity repulsion, conical float 55 and second fixing part 54 can not be maintained in a separation state, conical float 55 falls back to form an upper and lower sealing structure with second fixing part 54, at the moment, magnetoelectric switch 57 senses the position falling of conical float 55 to trigger the falling of conical float, and sends a signal to a CPU of the X-ray machine to close the running of the X-ray machine, so that ray tube 6 of the X-ray machine does not work when no cooling water exists, the ray tube 6 is effectively prevented from being in a high-temperature state for a long time, the service life of ray tube 6 is prolonged, and the operation cost of a company is greatly reduced.

In some embodiments, as shown in FIG. 2, the height h of conical float 55 is greater than the upper section diameter d of conical float 55. in the present improvement, conical float 55 cannot be turned upside down under the thrust of cooling water, and only can keep the state of downward vertex to float upside down, thereby improving the operational reliability of the present invention.

Figure 4:
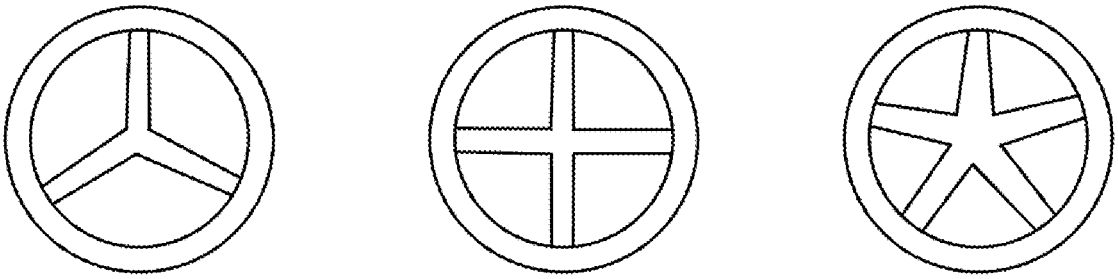
FIG. 4 is a transverse cross-sectional view of three embodiments of first fixing part of the present invention.

In some embodiments, first fixing part 52 may have a cross-section of three, four or five-pointed star shape, as shown in FIG. 4 *a, b* and *c*, or other transparent structures with fixing function, which can be easily conceived by those skilled in the art, and fall within the protection scope of the present invention.

In some embodiments, motor pump 2 motor can be three-phase asynchronous motor, one-way valve 4 can be spherical one-way valve, three-phase asynchronous motor and spherical one-way valve are industrial devices used more in factories, and can be directly obtained from warehouses without purchasing for general factories.

In some embodiments, the worker may read the threshold water flow that causes conical float 55 to float upward against the magnetic force (e.g., water flow meter 3 with a value greater than 60 L/min, with cooling water flowing, and less than 60 L/min, without cooling water flowing) based on the water flow meter 3 measurement.

In some embodiments, a cooling pump for cooling water is arranged between a water outlet of ray tube and a water inlet of water tank 1, a water inlet of the cooling pump is communicated with a water outlet of ray tube, and a water outlet of the cooling pump is communicated with a water inlet of water tank.

Compared with the prior art, the X-ray machine ray tube heat dissipation device of the present invention has the following advantages:

When the X-ray machine works, if water tank water leakage occurs, motor pump damage occurs, one-way valve is closed and the like, and water flow is zero or is too small, the thrust of the water flow is insufficient to overcome the magnetic force action of like polarity repulsion, conical float and second fixing part cannot be maintained to be in a separation state, conical float falls back to form an upper and lower sealing structure with second fixing part, at this time, the position falling back of magnetoelectric switch induction conical float is triggered, and a signal is sent to a CPU of the X-ray machine to close the X-ray machine to run, so that ray tube of the X-ray machine does not work when no cooling water exists, the working convenience of workers is improved, ray tube is effectively prevented from being in a high-temperature state for a long time, the service life of ray tube is prolonged, and the operating cost of a company is greatly reduced.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An X-ray machine ray tube heat dissipation device, comprising a heat dissipation pool and an X-ray machine ray tube placed in the heat dissipation pool, wherein a water inlet and a water outlet are formed in the heat dissipation pool, the water outlet of the heat dissipation pool communicates with a water inlet of a water tank, a water outlet of the water tank communicates with an input end of a motor pump, an output end of the motor pump communicates with an input end of a water flow meter, an output end of the water flow meter communicates with an input end of a one-way valve, an output end of the one-way valve communicates with an input end of a water flow electronic control unit, and an output end of the water flow electronic control unit communicates with the water inlet of the heat dissipation pool.

2. The X-ray machine ray tube heat dissipation device according to claim 1, wherein the water flow electronic control unit comprises a tubular structure, a first fixing part is arranged on an upper part of an inner wall of the tubular structure, a first through hole is formed in the first fixing part, and a first magnetic device is arranged on a lower end surface of the first fixing part.

3. The X-ray machine ray tube heat dissipation device according to claim 2, wherein a second fixing part is arranged on a lower part of the inner wall of the tubular structure, the second fixing part is configured to seal the tubular structure, a second through hole is formed in a position, corresponding to the first magnetic device, of the second fixing part, a matched sealing structure is arranged on the second through hole of the second fixing part, and a second magnetic device with the same magnetism with the first magnetic device is arranged on an upper part of the sealing structure.

4. The X-ray machine ray tube heat dissipation device according to claim 3, wherein the sealing structure comprises a conical float, a vertex of the conical float is embedded downwards in the second through hole of the second fixing part, and the second magnetic device is arranged on an upper end surface of the conical float.

5. The X-ray machine ray tube heat dissipation device according to claim 4, wherein a magnetoelectric switch is arranged on a position, corresponding to the second fixing part, of an outer side of a tube wall of the tubular structure, and the magnetoelectric switch is electrically connected with the ray tube.

6. The X-ray machine ray tube heat dissipation device according to claim 5, wherein the magnetoelectric switch is electrically connected with a CPU of the X-ray machine ray tube.

7. The X-ray machine ray tube heat dissipation device according to claim 4, wherein the conical float comprises a cone-shaped structure, and the second through hole of the second fixing part comprises a circular through hole.

8. The X-ray machine ray tube heat dissipation device according to claim 7, wherein a height h of the conical float is greater than an inner cross-sectional diameter d of the tubular structure.

9. The X-ray machine ray tube heat dissipation device according to claim 4, wherein the first magnetic device and the second magnetic device comprise magnets.

* * * * *